United States Patent [19]
Torrez
[11] 4,194,254
[45] Mar. 25, 1980

[54] FLOOR-SUPPORTED CUSHION ASSEMBLY AND METHOD OF MAKING SAME

[76] Inventor: Kay A. Torrez, 924 E. Washington, Phoenix, Ariz. 85034

[21] Appl. No.: 931,028

[22] Filed: Aug. 4, 1978

Related U.S. Application Data

[62] Division of Ser. No. 836,737, Aug. 26, 1977, Pat. No. 4,116,148.

[51] Int. Cl.[2] ..... A47C 13/00; A47C 7/14; A47G 9/00

[52] U.S. Cl. ..... 5/420; 5/12 R; 5/436; 5/465; 297/455

[58] Field of Search ..... 5/12 R, 337, 338, 339, 5/340, 341, 342, 355, 344, 420, 417, 436, 437, 442, 481, 482, 485; 297/229, 455, 382, 219; D6/201, 204

[56] References Cited

U.S. PATENT DOCUMENTS

| | | | |
|---|---|---|---|
| 2,593,056 | 4/1952 | Sage et al. | 5/340 |
| 2,667,915 | 2/1954 | Pferrer et al. | 5/337 |
| 3,346,298 | 10/1967 | Champion | 297/382 |
| 3,761,131 | 9/1973 | Oliver | 5/337 |
| 4,047,756 | 9/1977 | Ney | 297/219 |

FOREIGN PATENT DOCUMENTS

| | | | |
|---|---|---|---|
| 782695 | 6/1935 | France | 297/382 |

*Primary Examiner*—Alexander Grosz
*Attorney, Agent, or Firm*—Don J. Flickinger

[57] ABSTRACT

A floor-supported cushion assembly comprising a seat pad of foam material encased in one end portion of a fabric envelope, a back pillow consisting of a pillowcase filled with shredded polyurethane foam and received in the other end portion of the envelope, and a fabric hinge formed by portions of said envelope between said end portions. A zipper is installed in the envelope in its back and extends longitudinally into both end portions. The method of making the cushion assembly is also an important aspect of the invention.

9 Claims, 23 Drawing Figures

FLOOR-SUPPORTED CUSHION ASSEMBLY AND METHOD OF MAKING SAME

This is a division of application Ser. No. 836,737, filed Aug. 26, 1977, now U.S. Pat. No. 4,116,148.

The present invention relates to cushion assemblies of the type in which two cushions are hingedly connected and intended to be positioned for use with a seat cushion resting on a floor or comparable horizontal surface, and a back cushion is supported in an upright position by a wall or similar vertical surface, and is concerned primarily with the novel assembly of the cushions and method of making the same.

BACKGROUND OF THE INVENTION

It is believed that the prior art device closest to the subject cushion assembly is that disclosed in U.S. Pat. No. 3,761,131. In accordance with this patent, two pillows are filled with chunks of polyurethane foam and connected by sewing the rear edge of the cushion intended to be the seat cushion and the lower edge of the back cushion. This so-called "sofa-like article of furniture" presents certain defects which are intended to be obviated by the present invention.

In the first place, the seat cushion which supports the major part of a user's weight does not have the property of rigidity to the degree required to afford comfort to one sitting on it for prolonged periods. It is also lacking in squared corners at the forward end of the seat cushion which are highly desirable not only from the aspect of providing rigidity but also for appearance effects.

This patented article is also lacking in an envelope or casing in which the seat and back cushions are received as individual elements and a zipper-controlled slot through which the cushions may be passed.

This invention is founded on the concept that a seat cushion comprising a rectangularly shaped envelope of fabric and having spaced end portions, with one end portion receiving a pad of polyurethane and the other end portion receiving a pillow consisting of a pillowcase that is filled with shredded polyurethane foam with the fabric between the end portions forming a hinge, together with a zipper-controlled slot on the back of the envelope extending into both end portions, will meet with large public acceptance, particularly because it is susceptible of being made by individuals who have been properly instructed as to the method as compared to being manufactured in factories.

OBJECTS OF THE INVENTION with the foregoing conditions in mind, the present invention has in view the following objectives:

1. To provide a cushion assembly including a rectangularly shaped envelope having spaced end portions with a seat pad of polyurethane foam received in one end portion and a back pillow in the other end portion.

2. To provide, in a cushion assembly of the type noted, a back pillow consisting of a pillowcase which is filled with shredded polyurethane foam.

3. To provide, in a cushion assembly of the character aforesaid, a slot on the back of the envelope which affords access to the two end portions and which is controlled by a zipper.

4. To provide, in a cushion assembly of the kind described, a hinge between the end portions of the envelope which is made from the fabric of the envelope.

5. To provide, in a cushion assembly of the type noted, a seat end portion of the envelope having squared corners on its front end which snugly receive square corners of the seat pad.

6. To provide a method of making a cushion assembly of the character aforesaid which involves the use of a pattern for forming the envelope and which may be included in an instruction manual.

7. To provide, in a method of the kind described, the step of folding a rectangularly shaped piece of fabric of proper dimensions and having a decorative face on itself with the decorative face in engagement and the folded fabric being one-half the size of the original piece of fabric.

8. To provide, in a method of the type noted, the step of placing pieces separated from the pattern over end portions of the folded fabric, marking places where seams are to be sewed, and cutting out a recess from end edges of the folded fabric of the seat end portion of the envelope.

9. To provide, in a method of the character aforesaid, the step of sewing seams across end edges of the folded fabric and inwardly from each end seam a predetermined distance to leave space for a zipper-controlled slot.

10. To provide, in a method of the kind described, the step of cutting the recess in the end edge portion of the bottom part of the envelope to leave a rectangular recess having two pairs of identical geometric formations at each corner of the recess.

11. To provide, in a method of the character aforesaid, the step of pulling out the corners of the recess and folding so the matching geometric figures meet and sewing a seam spaced from the folded edges.

12. To provide, in a method of the kind described, the step of installing a zipper in the slot provided therefor.

13. To provide, in a method of the type noted, the steps of turning the envelope inside-out to bring the decorative face into exposed position; inserting a rectangularly shaped pad of polyurethane foam having square corners into the seat part of the envelope; and inserting a pillowcase filled with shredded polyurethane foam into the back part of the envelope.

14. To provide, in a method of the character aforesaid, the step of forming a hinge between the spaced end portions of the envelope by pressing the fabric back inwardly against the front face and sewing the engaging faces together.

15. And finally, to provide, in a method of the type noted, the step of attaching ornaments, such as tassels, to the upper corners of the envelope which receives the pillow.

SUMMARY OF THE INVENTION

The foregoing objects are achieved by providing a floor-supported cushion assembly which comprises a rectangular envelope having a seat end portion and a back end portion spaced therefrom. The envelope has decorative faces such as a cut pile fabric. The seat portion of the envelope has squared front corners and received in this end portion is a seat pad of a foamed material having the property of rigidity to a required degree, such as polyurethane foam, and which pad is snugly received in the aforesaid front corners.

The back portion of the envelope is filled with a pillow comprising a pillowcase filled with shredded foam material such as polyurethane foam. The back and seat portions of the envelope are connected by a fabric hinge formed from the fabric between these end portions which are forced into meeting engagement and stitched together. The back of the envelope is formed with a slot centrally thereof and extending into both end portions of the envelope with the ends of the slot being spaced from the ends of the envelope. A zipper is installed in this slot.

The method of making such a cushion assembly will be described in a manual which includes a removable pattern. It is intended that this method be susceptible of being carried out by a housewife or other individual as compared to factory production.

The first step of the method is to remove the pattern from the manual and cut it along lines inscribed thereon to separate it into a seat or bottom portion and a back or top portion.

The next step is to fold a piece of rectangular fabric of required dimensions on itself so that the decorative faces of the fabric meet and the folded piece will be one-half the size of the unfolded piece of fabric.

The next step is to place the two portions of the pattern over end portions of the folded fabric, mark lines where seams are to be formed, and cut out a rectangularly shaped recess from the end edge of the seat portion of the folded fabric centrally thereof, using the pattern part as a guide.

The next step is to sew a seam which is spaced inwardly from a free edge of the folded fabric a required distance from the end edge thereof, thereby leaving a space between the ends of these seams. These seams are then pressed open and moved to the center front and a seam is sewed along the edges of the top and bottom portions in spaced relation with the edges thereof. In this position, the recess which is formed in the center of the front edge of the seat part presents two geometric figures such as identical triangular points and identical half circles at each corner. The corner of the envelope is then opened to bring the triangular points into meeting overlapping relation and the half circles into meeting overlapping relation. A seam is then sewed across the two plies of the fabric in a properly spaced relation with the edges thereof whereby the length of this seam is the same as the thickness of the pad. Where edges of the folded fabric meet, another seam is formed and trimmed.

The envelope is now turned inside-out to bring the decorative face in exposed position, whereupon the zipper is inserted in the slot provided therefor.

The zipper is now opened and a foam pad is inserted in the bottom seat part of the envelope, making sure that the corners of the pad are snugly fitted in the end corners of the bottom part of the envelope.

A pillowcase is now formed from an appropriate fabric by sewing along the four edges of two rectangularly shaped pieces of the fabric, leaving an unsewn space sufficient to permit the insertion of shredded polyurethane foam thereinto. After the pillowcase is filled, this opening is closed by stitching. The pillow is stuffed into the seat or top part of the envelope and shaken so that it snugly fills this part of the envelope, whereupon the zipper slot is closed.

The envelope with the foam pad and pillow therein is now placed on a flat surface, such as a floor, with the face having the zipper disposed downwardly. The fabric in the space between the seat and back portions of the envelope will form the hinge. Pressure is applied to the upper ply of the fabric in this position to force it downwardly against the back ply, whereupon the two plies are temporarily secured together by a required number of safety pins, after which the plies are sewn together and the safety pins removed.

Finally, ornaments such as tassels are sewn to top corners of the back portion of the envelope For a full and more complete understanding of the invention, reference may be had to the following description and accompanying drawings, wherein.

DESCRIPTION OF A PREFERRED EMBODIMENT

Figure 1:
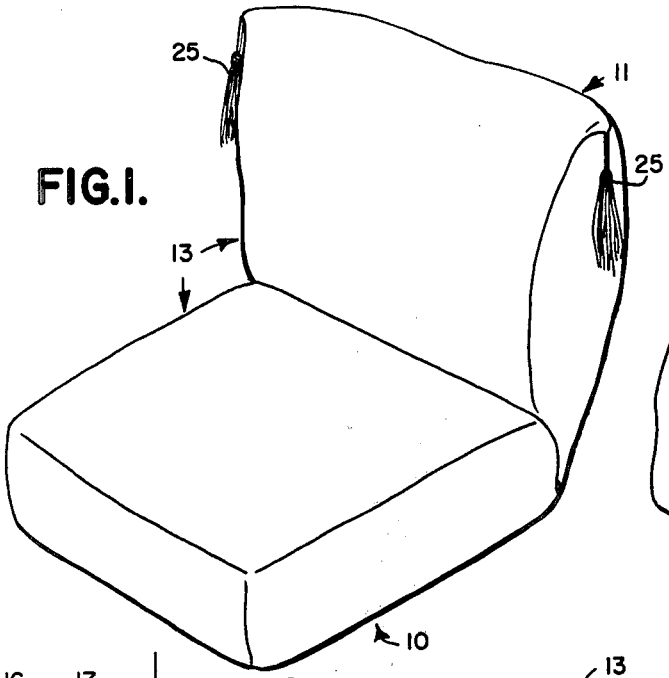
FIG. 1 is a perspective of a seat cushion assembly designed in accordance with the precepts of this invention.
Figure 21:
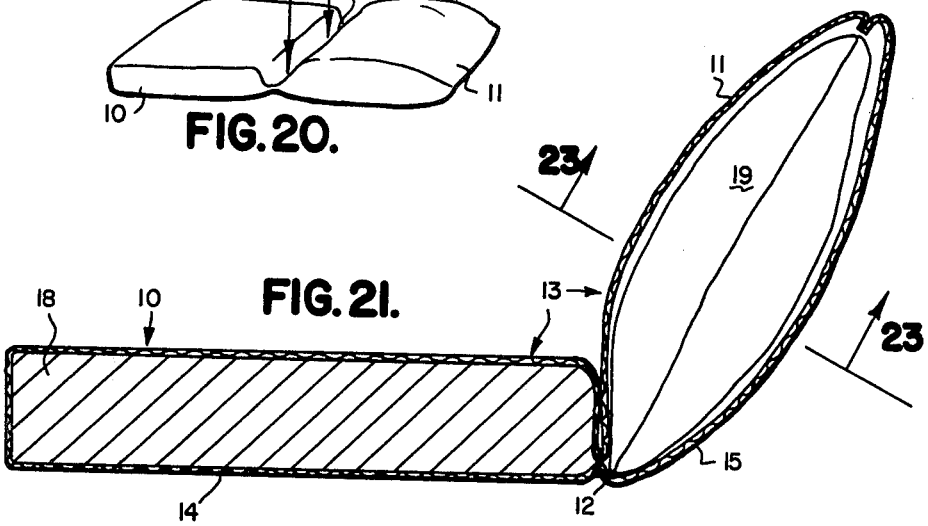
FIG. 21 is a longitudinal section through the envelope with the pad and pillow inserted therein.

Referring now more particularly to FIGS. 1 and 21, the cushion assembly of this invention is shown as comprising a seat or bottom part referred to in its entirety at 10, and a back part designated generally 11. These two parts are connected by a fabric hinge shown at 12 in FIG. 21. An envelope, referred to in its entirety at 13, comprises a seat or bottom end portion 14 and a back or pillow portion 15, as shown in FIG. 21.

Figure 2:
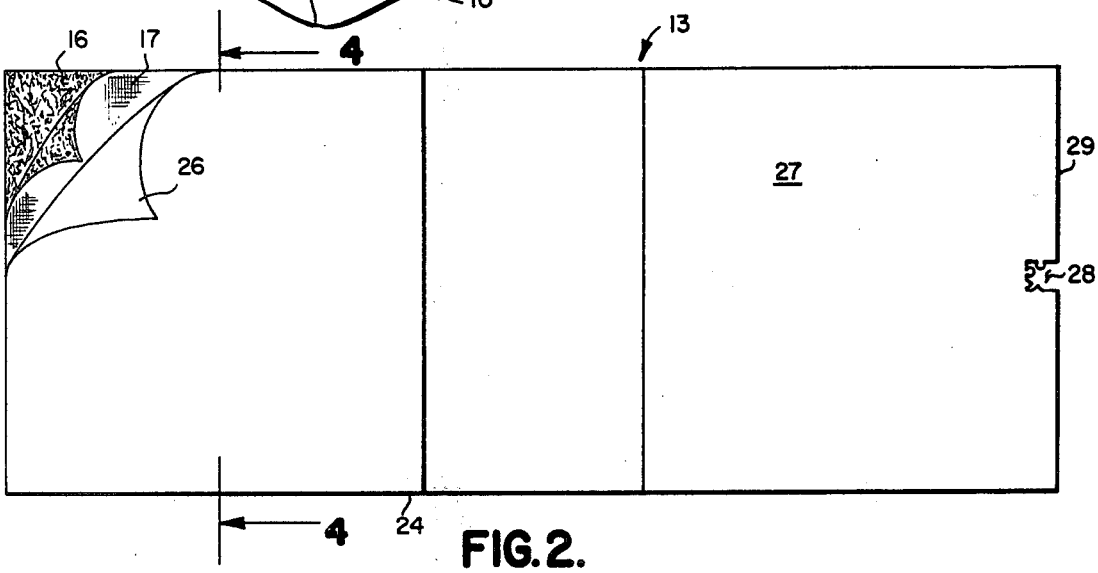
FIG. 2 is a plan view of a piece of fabric having a decorative face folded back on itself with portions of a pattern positioned over end portions of the fabric. In this view, the plies of the fabric and the pattern are pealed back at one corner to facilitate illustration thereof.
Figure 4:
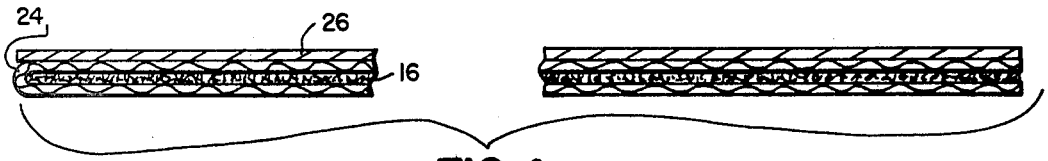
FIG. 4 is a detail taken on an enlarged scale transversely of one end portion of the envelope and pattern part thereon.

Referring more particularly to FIGS. 2 and 4, envelope 13 is of a fabric having a decorative face 16 such as one of cut pile, and a plain back 17. Received in the seat part 14 of envelope 13 is a pad 18 of a foam material having the property of rigidity to the degree required for enabling a user to sit thereon with comfort over prolonged periods. Polyurethane is the preferred foamed material.

Figure 23:
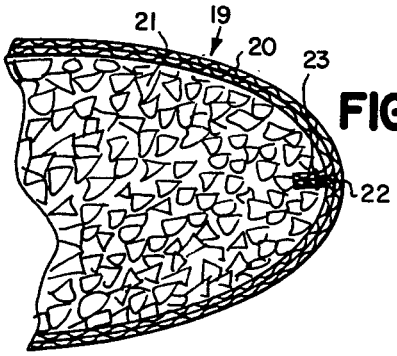
FIG. 23 is a detailed section on an enlarged scale through a portion of the pillow being taken on the plane of the line 23—23 of FIG. 21.

As shown in FIG. 21, back part 15 of the envelope is filled with a pillow 19 which, as shown in FIG. 23, comprises a fabric pillowcase 20 that is filled with shredded polyurethane foam 21. Pillow 19 is formed by leaving a slot 22 therein of sufficient extent to permit of the shredded foam being inserted therethrough after which the slot 22 is closed by stitching 23.

Envelope 13 is formed from a rectangular piece of fabric having a decorative face 16 and back 17. While the dimensions of this piece of fabric may vary, by way of example it is noted that it is 60 inches long and 54 inches wide. When folded along a longitudinal center line, such as indicated at 24 in FIG. 2, the folded piece will present two plies each 27 inches wide. These two plies are pressed together to form the hinge shown at 12 in FIGS. 20 and 21.

It is evident that seat cushion 10 may be placed on a floor or a comparable horizontal surface, and back 11 against a wall or similar support.

Figure 22:
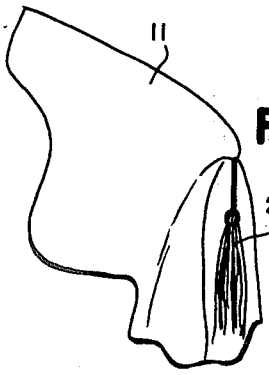
FIG. 22 is a detailed perspective of one corner of the back of the envelope with a tassel attached thereto.

As shown in FIG. 22, an ornament such as a tassel 25 may be attached to each upper corner of back 11.

The Method

It is contemplated that the above-described cushion assembly be susceptible of production by a housewife or other individual and, to enable her to do so, a manual of instructions will be distributed and this manual will include a pattern which may be detached from the manual and separated to provide two parts—one for the seat or bottom, and one for the back or top. The pattern before being so separated is not illustrated; however, as shown in FIG. 2, it provides a back or pillow part 26 and a bottom or seat part 27.

Figure 3:
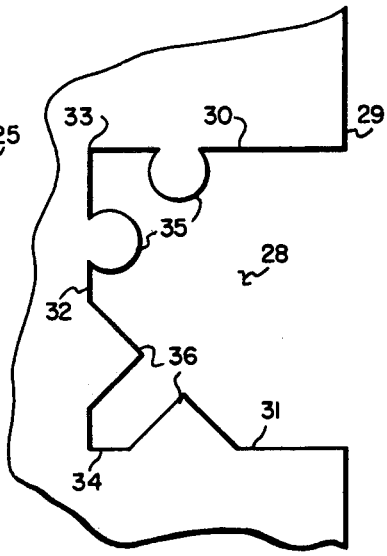
FIG. 3 is a plan view taken on an enlarged scale of the recess which is formed centrally of the end edge of both plies of the folded fabric of the seat portion.

The first step of the method is to fold the piece of fabric into the position of FIG. 2 in which the cut pile faces of the two plies are in meeting engagement. The top or pillow pattern part 26 is placed over one end portion, and the back or seat part 27 over the other end portion. In this position, a generally rectangularly shaped recess 28 is cut in both plies at the end edge 29 of seat part 27. This recess 28 is clearly shown in detail in FIG. 3. It is defined by side edges 30 and 31 and a bottom edge 32. These edges provide corners 33 and 34. Two identical formations of the same geometric design extend into recess 28 from the side edge 30 and end edge 32 at corner 33 and preferably take the form of the partial circles 35. Similarly, formations of identical geometric design, but different from the partial circles 35, such as points 36, extend into recess 28 from side edge and end edge 32 at corner 34.

Figure 5:
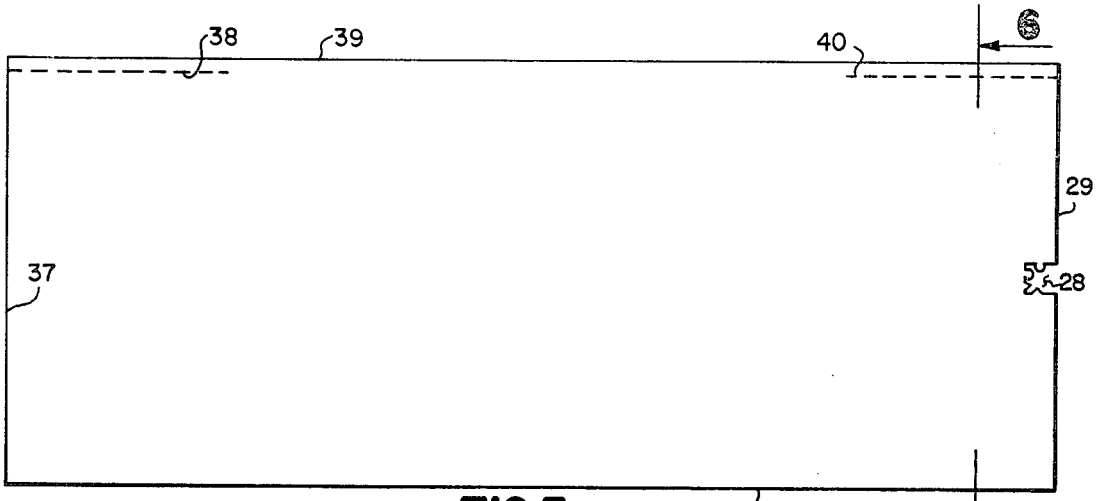
FIG. 5 is a plan view of the folded fabric illustrating the seams which are formed therein at the free edges of the plies.
Figure 6:
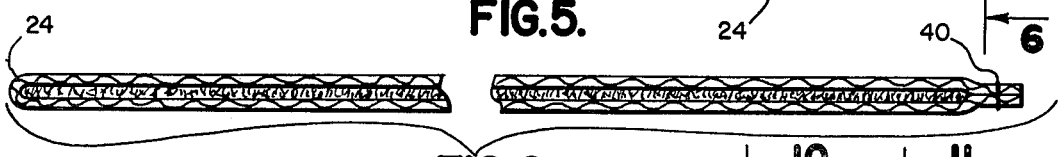
FIG. 6 is a transverse section on an enlarged scale taken on the lines 6—6 of FIG. 5.

Both plies of the folded fabric have an end edge remote from edge 29, as shown at 37. As illustrated in FIG. 5, a seam 38 is sewn inwardly from end edge 37. This seam is spaced from free edges 39 of both plies an appropriate distance, such as one inch for the dimensions of the present embodiment. A similar seam 40 extends inwardly from end edge 29. These seams 38 and 40 extend inwardly of the folded fabric sufficient to leave a slot 41 of a required length for the purpose of receiving a zipper.

Figure 7:
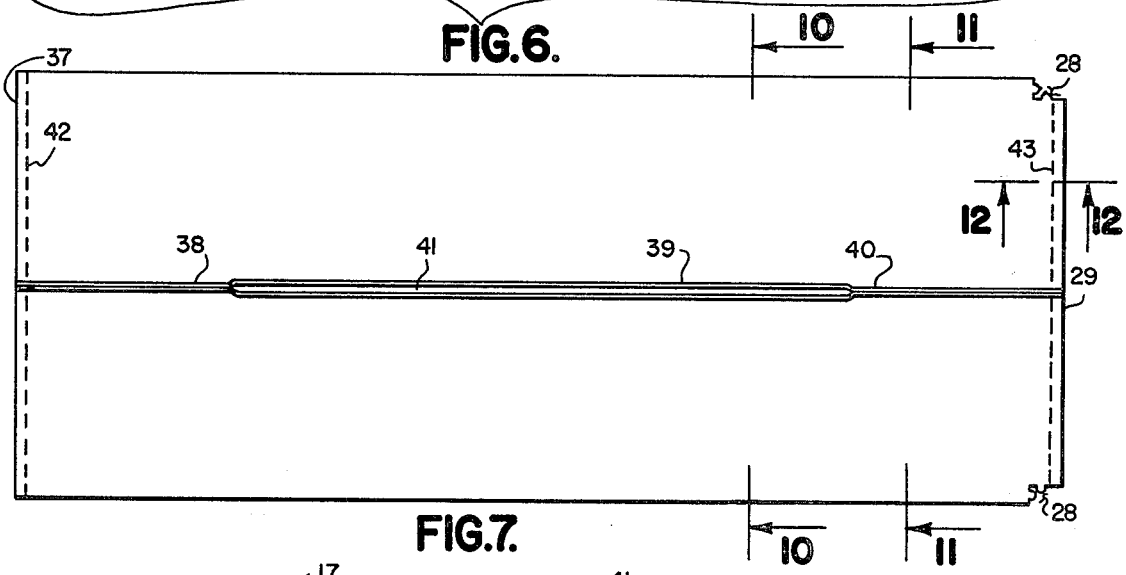
FIG. 7 is a top plan view of the folded and seamed fabric after it has been adjusted to bring the seams into a central position, leaving a center slot for a zipper.
Figure 9:
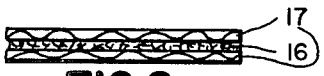
FIG. 9 is a detailed section taken on the plane of the line 9—9 of FIG. 8.
Figure 8:
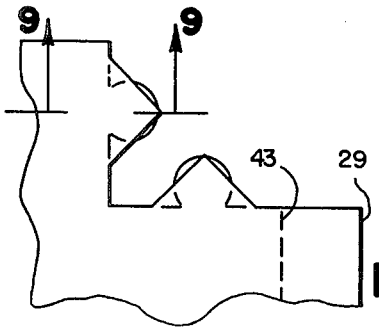
FIG. 8 is a detail plan on an enlarged scale of one corner of the envelope in the position indicated in FIG. 7.

The next step of the method is to open these seams 38 and 40 and adjust the fabric into the position of FIG. 7 in which the seams 38 and 40 are located centrally of the folded piece. In this position, the recess 28 of each ply provides a corner formation which is more clearly illustrated in FIG. 8. A seam 42 is now sewn adjacent to end edge 37 and another seam 43 adjacent to end edge 29.

Figure 10:
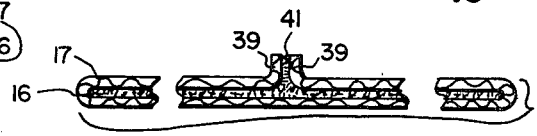
FIG. 10 is a detailed section taken on the plane of the line 10—10 of FIG. 7.
Figure 11:
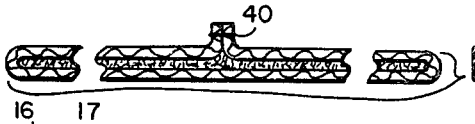
FIG. 11 is a detailed section similar to FIG. 10 but taken on the plane of the line 11—11 of FIG. 7.
Figure 12:
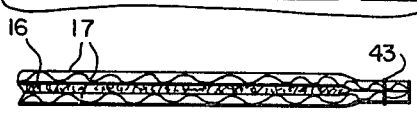
FIG. 12 is a detailed section taken on the plane of the line 12—12 of FIG. 7.

As shown in FIG. 7, those portions of the free edges 39 between seams 38 and 40 provide the slot 41. The slot 41 is shown in transverse section in FIG. 10. The seam 40 is illustrated in FIG. 11 and seam 43 in FIG. 12.

Figure 13:
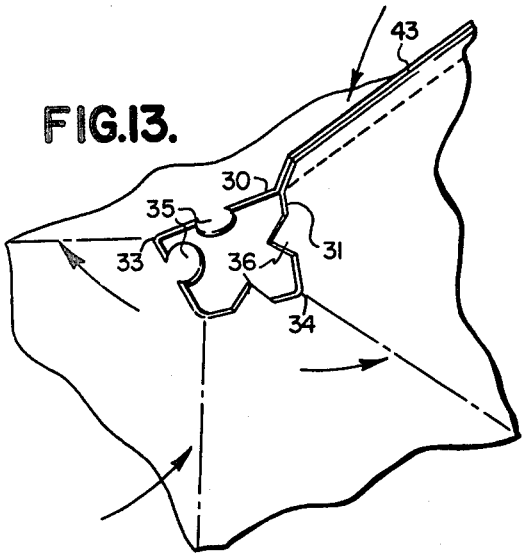
FIG. 13 is a perspective of one corner of the envelope in a distended position.
Figure 14:
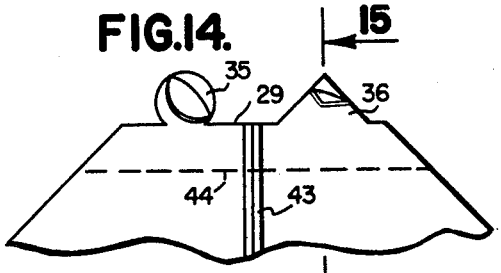
FIG. 14 is an elevation of one corner after the plies have been pressed together with the points and circles matching and overlapping.
Figure 15:
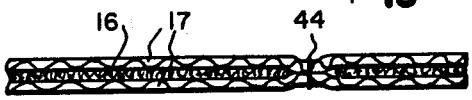
FIG. 15 is a detailed section taken on the plane of the line 15—15 of FIG. 14.

Each corner with the recess 28 therein is opened into the position of FIG. 13, whereupon the corner is closed into the position of FIG. 14 in which the partial circles 35 and triangular points 36 overlap, thereby insuring accurate positioning of the plies of the fabric. Another seam is now sewn along line 44 as illustrated in FIG. 14. This seam at 44 is spaced one-half inch from the adjacent portion of end edges 29.

Figure 17:
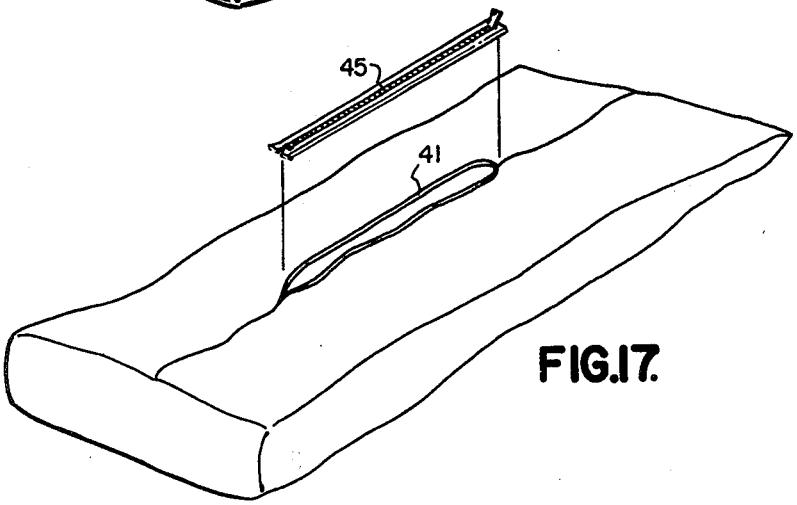
FIG. 17 is a detailed perspective depicting the zipper in exploded relation with respect to the slot provided therefor.

The next step in the method is to turn the envelope inside-out to bring the cut pile face 16 to exposed position. A zipper 45 is then positioned in slot 41 and firmly secured by sewing, this being shown in FIG. 17.

Figure 16:
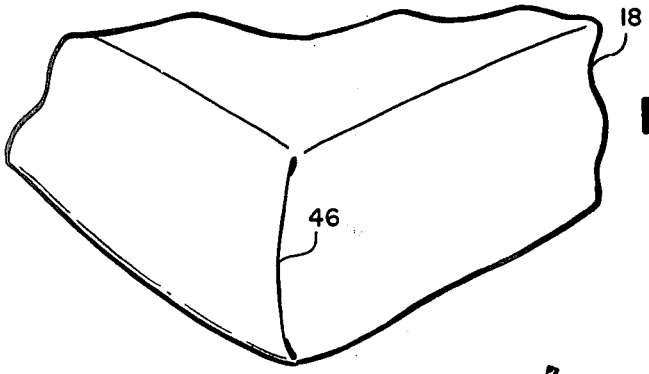
FIG. 16 is a detailed perspective of one corner of the seat pad.

A portion of the foam pad 18 is illustrated in FIG. 16 and presents two corners, one of which is shown at 46 at its front end. These corners fit into front end corners of the seat part 14 of envelope 13.

Figure 18:
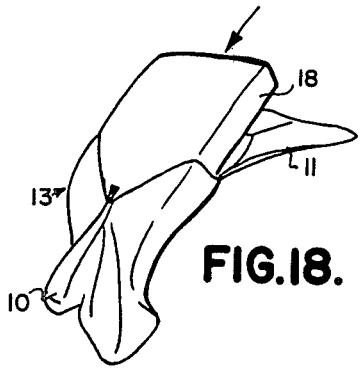
FIG. 18 is a detailed perspective illustrating the insertion of the seat pad into the end portion of the envelope provided therefor.
Figure 19:
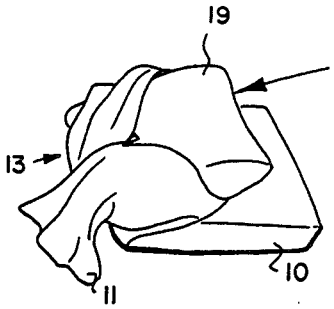
FIG. 19 is a detailed perspective showing the insertion of the pillow into the back portion of the envelope provided therefor.

After zipper 45 is positioned, it is opened and seat pad 18 is inserted into envelope part 14, as shown in FIG. 18. Pillow 19 is then inserted through the open slot into back part 11, as shown in FIG. 19.

Figure 20:
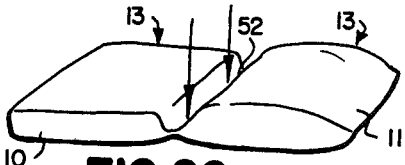
FIG. 20 is a perspective illustrating the construction of the fabric hinge between the two parts of the envelope.

The next step in the method is to form hinge 12 by pressing the two plies of the fabric together, as shown in FIG. 20. These plies may then be temporarily secured together as by an appropriate number of safety pins, such as four pins, after which they are sewn together by strong stitches and the safety pins removed.

The final step is to attach the tassels 25 to the upper corners of back part 11, as shown in FIGS. 1 and 22.

While a preferred specific embodiment of the invention is hereinbefore set forth, it is to be clearly understood that the invention is not to be limited to the exact construction, materials and steps illustrated and described because various modifications of these details may be provided in putting the invention into practice.

What is claimed is:

1. In a floor-supported cushion assembly:

(a) a rectangularly shaped fabric envelope having a seat end portion and a back end portion spaced from said seat end portion;

(b) a pad of foam material having the property of rigidity to a required degree removably received in said seat end portion;

(c) a pillow comprising a pillowcase filled with a shredded foam material removably received in said back end portion;

(d) a hinge between said end portions formed from the fabric of said envelope;

(e) said envelope having a centrally located longitudinal slot extending into both of said end portions; and (f) a zipper attached to said envelope in said slot and operable to open and close said slot.

2. The cushion assembly of claim 1 in which the pad is formed of polyurethane.

3. The cushion assembly of claim 1 in which the shredded foam material is polyurethane.

4. The cushion assembly of claim 1 in which the fabric envelope has a decorative outer face and a plain inner face.

5. The cushion assembly of claim 4 in which the envelope is of a cut pile fabric.

6. The cushion assembly of claim 1 in which the seat end portion of the envelope has an upper wall and a bottom wall and the back end portion has a front wall and a rear wall, with said slot being formed in said bottom and rear walls and terminates at points spaced from the end edges of the envelope.

7. The cushion assembly of claim 6 in which front corners of the seat end portion are square and the corresponding corner portions of the pad are square and snugly received in said front corners of the seat end portion.

8. The cushion assembly of claim 1 together with ornaments attached to the upper corners of the back end portion of the envelope.

9. The cushion assembly of claim 8 in which the ornaments are tassels suspended from the upper corners of the back end portion of the envelope.

* * * * *